US006008566A

United States Patent [19]

Brown et al.

[11] Patent Number: 6,008,566

[45] Date of Patent: Dec. 28, 1999

[54] LAMP MOUNTING ASSEMBLY WITH BANDING STRAPS

[75] Inventors: Randall D. Brown, Barrington; Joseph C. Swadel, Salem; Lawrence Crainich, Charlestown; Steven Walker, Acworth, all of N.H.

[73] Assignee: Osram Sylvania Inc., Danvers, Mass.

[21] Appl. No.: 09/066,155

[22] Filed: Apr. 24, 1998

Related U.S. Application Data

[60] Provisional application No. 60/046,125, May 9, 1997.

[51] Int. Cl.[6] ..... H01J 61/34; H01J 5/48

[52] U.S. Cl. ..... 313/25; 313/634

[58] Field of Search ..... 313/25, 634, 573, 313/292, 238

[56] References Cited

U.S. PATENT DOCUMENTS 5,023,505 6/1991 Ratliff et al. ..... 313/25
5,339,001 8/1994 King et al. ..... 313/25
5,521,458 5/1996 Kulik, Jr. ..... 313/25

*Primary Examiner*—Michael H. Day
*Attorney, Agent, or Firm*—William H. McNeill

[57] ABSTRACT

A lamp mount assembly (9) includes: a centrally located glass stem (10) having a convex surface; upper and lower banding straps (11, 13) circumferentially encompassing, and crimped to, the centrally located glass stem (10), the banding straps (11, 13) each further comprising oppositely disposed crimp portions, a first of the crimp portions being an interlocking crimp portion (12*a*, 12*b*) and a second of the crimp portions being a solid crimp portion (13*a*), the interlocking crimp portion of the upper banding strap (11) overlying the solid crimp portion (13*a*) of the lower banding strap (13); and a pair of mount frames (14) disposed about the centrally located glass stem (10), the banding straps (11, 13) holding the mounting frames (14) in place about the glass stem (10), the mounting frames (14) having a coined, concave surface substantially matching the convex surface of the glass stem (10). The banding straps including oppositely disposed crimp portions, of the present invention, reduces breakage of the glass stem.

3 Claims, 4 Drawing Sheets

LAMP MOUNTING ASSEMBLY WITH BANDING STRAPS

RELATED APPLICATION

This application claims the benefit of U.S. Provisional Application Ser. No. 60/046,125, filed May 9, 1997.

FIELD OF THE INVENTION

This invention relates to the fabrication of metalarc lamps and, more particularly to a new banding strap for supporting the mount frames about the glass stem of a new metalarc lamp mount assembly, which is automatically crimped by means of an automatic crimping mechanism.

BACKGROUND OF THE INVENTION

In the manufacture of metalarc lamps, it is necessary to properly orient and strap mount frames about a glass stem of the lamp. This banding procedure places a metal strap over the mount frames and the glass stem, thus holding the mount frames, with proper orientation, about the glass stem.

The original fabrication procedure hand-crimped the metal strap, resulting in a labor-intensive method. The strap was clinched at a single point about the glass stem and mount frames. In addition to being labor-intensive, this method was ineffective; the proper alignment of the frames about the glass stem was not always achieved. Another problem common to this earlier procedure was maintaining a small, compact configuration of the band around the glass stem, so that subsequent manufacturing processes could be accommodated. A further problem with the aforesaid procedure was its inability to maintain proper stem tolerances and hand crimping pressure. Stem breakage was a fairly common occurrence. Needless to say, the hand clinching of the strap about the lamp frames and glass stem was both costly and inefficient.

The present inventors have developed a new banding procedure that can be used for automatically crimping a new metalarc lamp mount assembly. The metal straps holding the mount frames about the glass stem comprises two banding pieces. The straps provide for proper alignment and radial orientation of the frames. The proper alignment results in part from a pair of pressure-relieving interlocks that are each clinched at opposite pole centers of the strap. The interlocks each comprise a fold-over configuration. Each interlocking portion of the strap allows for material to be pulled back from the fold-over configuration as it is being crimped. The pull-back of the material releases tension along the strap during crimping. The variability in glass stem diameters among lamp units is no longer a factor in banding strap tension. Thus, stem breakage is now substantially eliminated.

The crimps that are formed are very compact. The interlocking portions are physically as close as possible to the glass stem. This compactness resolves the inability of the prior hand procedure to control the final sub-assembly envelope diameter. In other words, the present inventive banding straps provide a more compact and uniform product.

DISCLOSURE OF THE INVENTION

In accordance with an aspect of the present invention, there is provided a new banding procedure for fabricating a new metalarc lamp mount assembly. The banding straps are automatically crimped by a new crimping mechanism that crimps the banding straps about the glass stem support. The banding straps comprises two interlocking band sections. The banding straps circumferentially encompasse the glass stem and mount frames. The interlocking sections mechanically bind the straps about the glass stem. The interlocking sections are disposed at opposite pole centers of the strap. The pole centers are positioned at approximately ninety degrees from each of the mount frames. Forming tools engage the banding strap at each pole center, initiating a crimping process, wherein the strap locks the mount frames into proper orientation with respect to the glass stem. At approximately thirty degrees past the horizontal working plane, the straps are locked into their final position. Then, two oppositely directed crimping tools cam over the interlocking portions of the strap. The fold-over configuration of each interlocking portion of the straps allows for material to be pulled back from each interlock portion as its respective crimping tool is operative. The pull-back of material during the crimping procedure releases tension along the strap. The variability in glass stem diameters among lamp units is no longer a factor in proper banding strap tension. Thus, stem breakage is now substantially eliminated. The crimp that is formed is very compact, and the interlocking portions are physically as close as possible to the glass stem.

It is therefore, an object of the present invention to obviate the disadvantages of the prior art.

It is another object of this invention to provide an improved lamp assembly comprising a new banding strap that releases its excess tension as it is fixed about a pair of mount frames and a glass stem of the lamp.

It is a further object of the invention to provide a compact assembly for affixing a pair of mount frames to a glass stem of a metalarc lamp mount assembly.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Generally speaking, there is shown an improved assembly for fabricating a metalarc lamp. The metalarc lamp comprises a glass stem, mount frames, and a new banding procedure for circumferentially encompassing and binding the mount frames to the glass stem. The banding straps are mechanically clamped about the glass stem at opposite pole centers, and then interlocking portions of the banding straps are crimped to affix the mount frames with respect to the glass stem.

Figure 1:
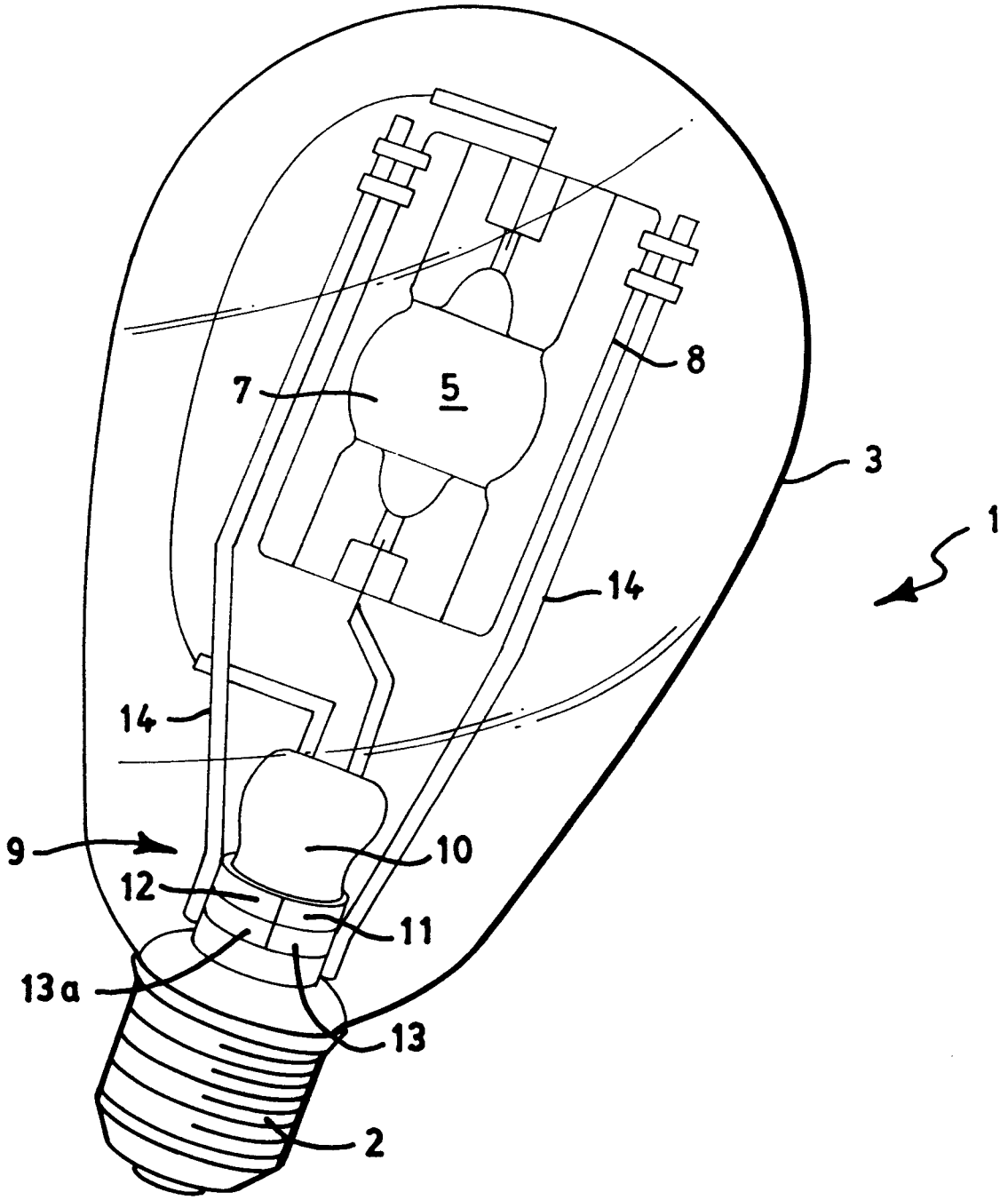
FIG. 1 illustrates a perspective view of a metalarc lamp of this invention featuring the new mount assembly.

Now referring to FIG. 1, a metalarc lamp 1 is shown with the new mount assembly 9. The metalarc lamp 1 comprises a metal base 2, an outer glass envelope 3 attached to the metal base, and a glass stem 10 of the new mount assembly 9. The glass stem 10 supports the mount frames 14, the arc tube 7, a shield 8, and the internal lamp workings 5. The mount frames 14 are secured to the glass stem 10 by means of plural metal banding straps 11 and 13, which are crimped by the automatic crimping mechanism 20, illustrated in FIGS. 2, 4 and 6.

Figure 8:
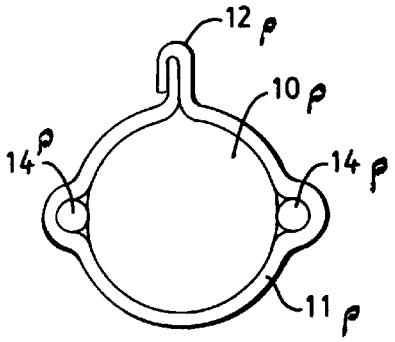
FIG. 8 (PRIOR ART)
FIG. 8 illustrates a plan view of a portion of a prior art metalarc lamp comprising a banding strap disposed over mount frames and a glass stem, with the banding strap comprising only one interlock section.

Referring to FIG. 8, the glass stem portion 10*p* and mount frames 14*p* of a mount assembly of a prior art metalarc lamp are illustrated. The banding strap 11*p* of the mounting assembly comprises only one interlocking crimp section 12*p* (depicted in a non-crimped position), which is subsequently crimped by hand. The banding strap 11*p* circumferentially surrounds the glass stem 10*p* and the two mount frames 14*p*, as illustrated. Additionally, the mounting frames 14*p* had a circular cross-section where they contacted the glass stem portion 14*p*.

Figure 2:
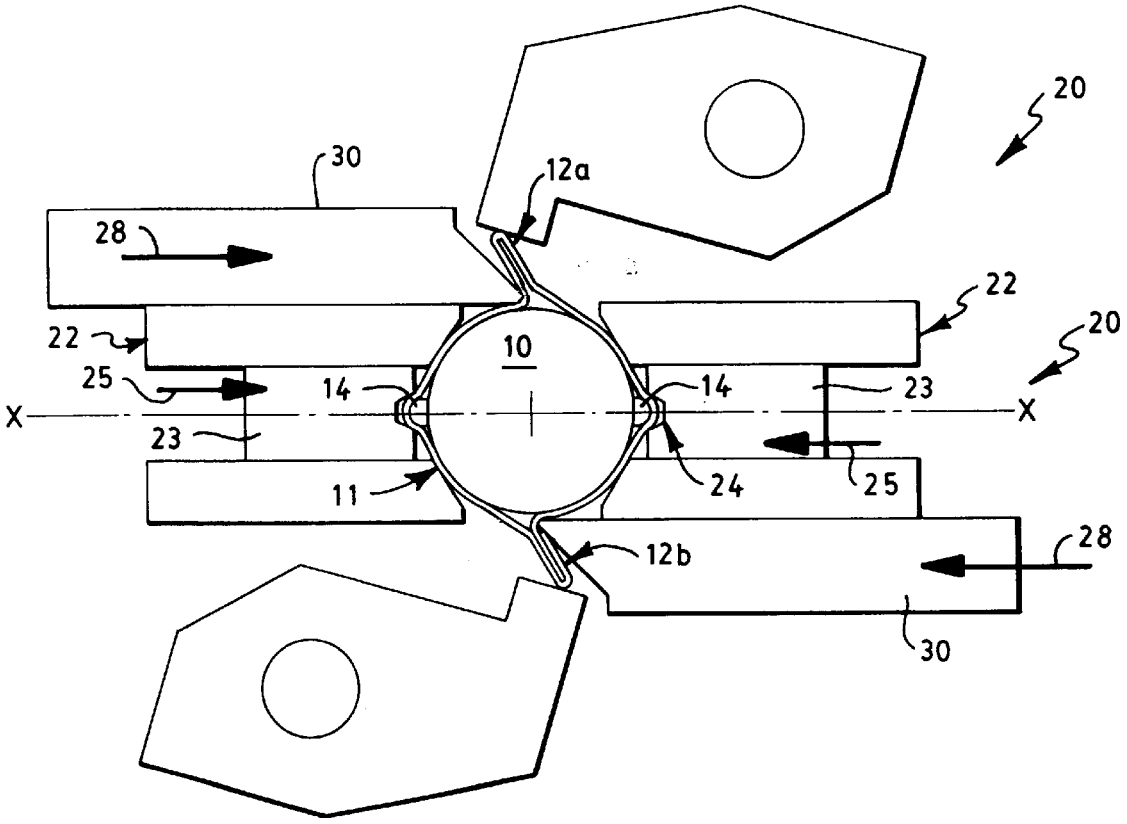
FIG. 2 depicts a plan view of a portion of a metalarc lamp mount assembly disposed in an automatic crimping mechanism.
Figure 3:
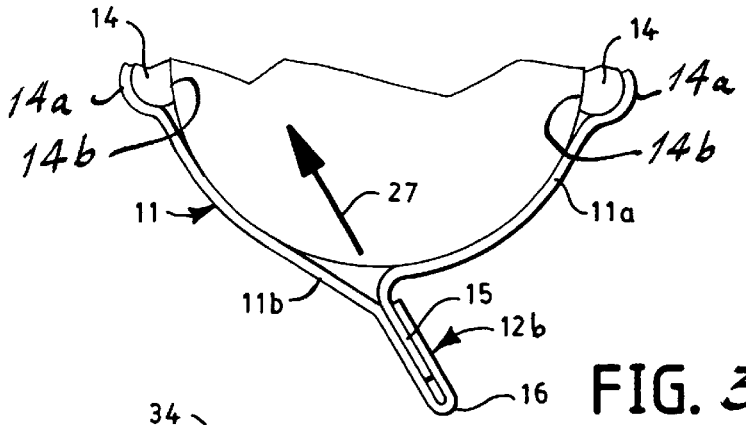
FIG. 3 shows an enlarged plan view of one of the interlocking sections of one of the banding straps disposed in the pivotally formed position, as depicted in FIG. 2.

Referring to FIG. 2, the glass stem portion 10 of the mounting assembly 9 of the lamp 1 of FIG. 1 is shown disposed within a fabricating mechanism 20 in accordance with this invention. An interlocking crimp section 12*b* and a solid crimp section 12*a*, are illustrated for the banding strap 11. Banding strap 13 is similarly formed with an interlocking crimp section and a solid crimp section (only one of which, crimp section 13*a*, is shown in FIG. 1) and is positioned beneath strap 11, as shown in FIG. 1; however, banding strap 13 is reversed from strap 11, i.e., the interlocking crimp section of strap 13 is beneath the solid crimp section of strap 11. The interlocking crimp sections are diametrically disposed at opposite pole centers, and are formed at the ends of the two banding strap sections 11 and 13, respectively. Each end 15 of a respective banding strap is free to slide out (arrow 27) of the folded-over, coined section 16, as shown in greater detail in FIGS. 3 and 5. The ability of the end 15 to slide from within the coined, folded-over, section 16 is of paramount importance in providing an adjustable tension throughout the banding straps 11 and 13 during the crimping operation, as will be more fully explained hereinafter, with respect to FIGS. 3 and 5.

Equidistantly spaced about the periphery of the straps 11 and 13 are receiving bumps 14*a* for receiving mounting frames 14. Preferably, the straps 11 and 13 are welded to mounting frames 14 at bumps 14*a*. Additionally, the ends of the mounting frames 14 which engage the outer surface of glass stem 10 are coined to have a concave surface curvature 14*b* which closely matches the convex curvature of the glass stem 10. This matching of curvatures greatly relieves the tensions built up by the prior art construction shown in FIG. 8, where there was essentially only point contact between the mounting frames and the glass.

The mechanism 20 comprises two stem strap clamping tools 22. Each strap clamping tool 22 has a center portion 23 having a V-shaped mouth that engages the banding strap 11 about one of the mount frames 14, as shown. The clamping tools 22 are each slid into place about their respective mount frames 14, as illustrated by arrows 25. The clamping tools 22 capture and position the banding strap 11 and mount frames 14 with respect to the glass stem 10. After the mount frames 14 have been located with respect to the glass stem 10, two pivot point forming tools 30 are caused to engage with the interlocking crimp sections 12*a* and 12*b*. This result is achieved by sliding (arrow 28) the forming tools 30 into position.

Figure 6:
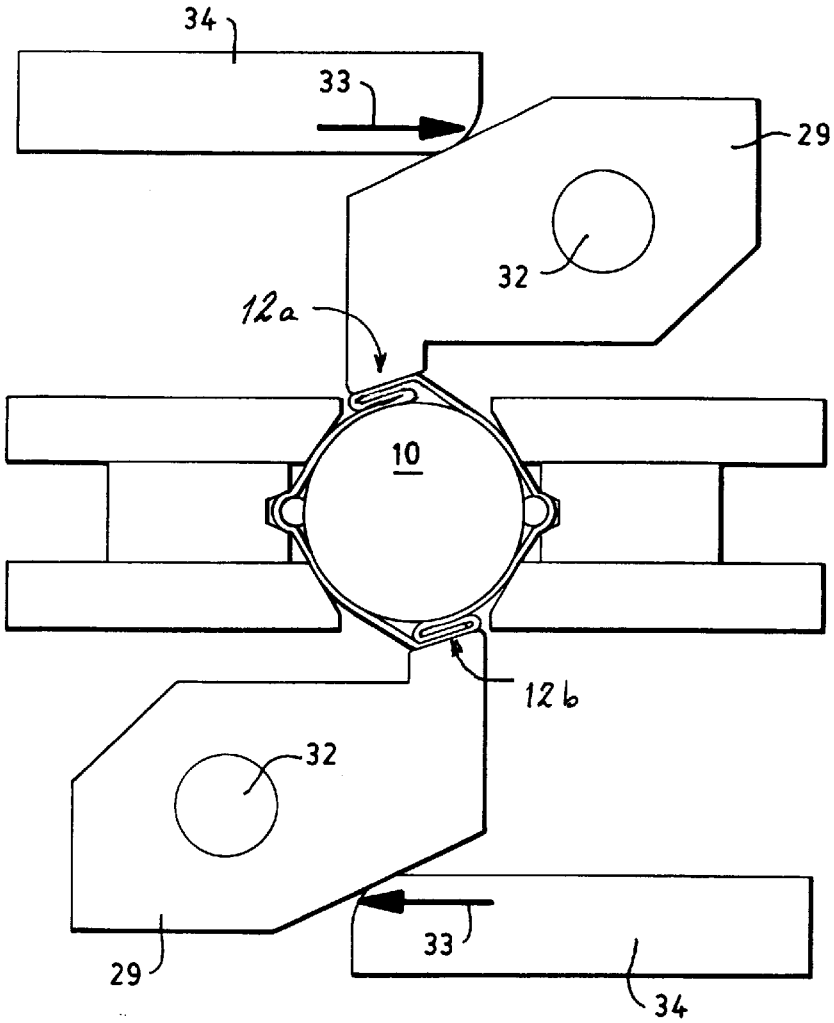
FIG. 6 shows a plan view of the metalarc lamp mount assembly of FIG. 2 with the interlocking section of one of the banding straps depicted in fully crimped position within the automatic crimping mechanism.
Figure 7:
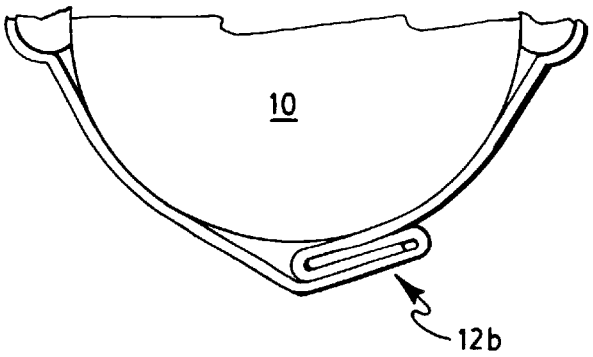
FIG. 7 depicts an enlarged plan view of one of the interlocking sections of one of the banding straps of FIG. 6, with the interlocking section shown in its fully crimped position.

At approximately thirty degrees past the horizontal working plane X—X, as illustrated in FIG. 2, the straps 11 and 13 are locked into their final position, as shown in FIGS. 6 and 7.

Figure 4:
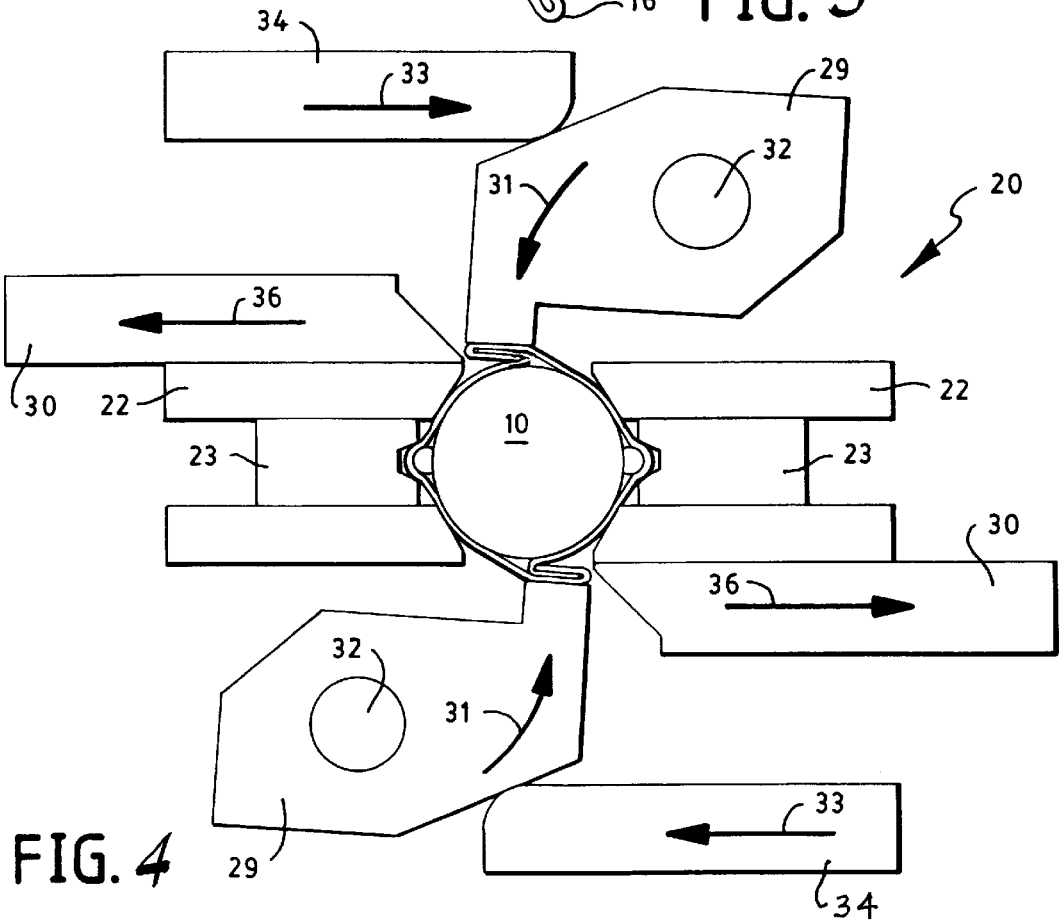
FIG. 4 illustrates a plan view of the metalarc lamp mount assembly of FIG. 2 with the interlocking section of one of the banding straps shown in crimped, pull-back position within the automatic crimping mechanism.

Referring to FIGS. 2 and 4, the crimping operation is illustrated. The crimping hammers 29 are pivotable about pivot point 32. The crimping hammers 29 swing into contact with the respective crimping portions, as shown by arrows 31. The crimping hammers 29 are caused to pivot into engagement with the crimping portions 12*a* and 12*b* by means of the respective closure crimp form tools 34. The closure crimp form tools 34 slide (arrows 33) into engagement with the crimping hammers 29, thus causing them to pivot about point 32 and to contact crimping portions 12*a* and 12*b*, as shown.

Figure 5:
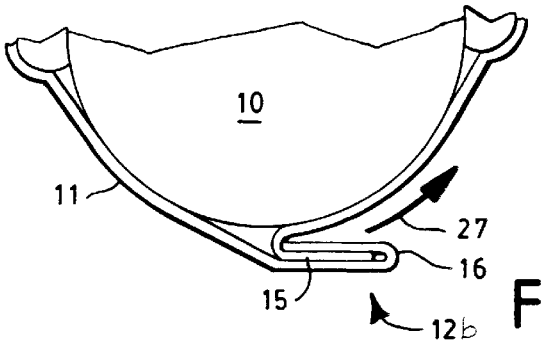
FIG. 5 depicts an enlarged plan view of one of the interlocking sections of the banding strap of FIG. 4, with the interlocking section in its respective crimped, pullback position.

The fold-over configuration of each of the crimping portions of the straps 11 and 13 allows for each end portion 15 to be pulled back (arrow 27) from each folded-over section 16, as its respective crimping tool 29 is operative, as shown in FIG. 5. The pull-back of the end portions 15 during the crimping procedure releases tension along the straps 11 and 13.

It should be observed that when the closure crimp form tools 34 are slidably operative against their respective crimping hammers 29, the pivot point forming tools 30 are caused to retract, as illustrated by arrows 36.

Referring to FIGS. 6 and 7, the final crimp position is shown for the interlock crimp portion 12*b* and the solid crimp portion 12*a* of strap 11, it being understood that strap 13, with its crimps reversed, is positioned beneath strap 11. In this position, the crimping hammers 29 have fully pivoted about pivot points 32, and the closure crimp form tools 34 have been fully extended (arrows 33) against the crimping hammers 29. It will be observed from FIG. 6, that the crimp portions 12*a* and 12*b* are compacted against the glass stem 10, presenting a very low and compact profile.

It should be understood that all of the various movable parts of the mechanism 20 are timed to interact with each other to provide a proper sequence of movement in order to accomplish each of the crimping events described above.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A lamp mount assembly, comprising:

a centrally located glass stem having a convex surface;

upper and lower banding straps, said banding straps circumferentially encompassing, and having been crimped to, said centrally located glass stem, said banding straps each further comprising oppositely disposed crimp portions, a first of said crimp portions being an interlocking crimp portion and a second of said crimp portions being a solid crimp portion, said interlocking crimp portion of said upper banding strap overlying the solid crimp portion of said lower banding strap; and a pair of mount frames disposed about said centrally located glass stem, said banding straps holding said mount frames in place about said glass stem, said mount frames having a coined, concave surface substantially matching said convex surface of said glass stem.

2. The lamp mount assembly of claim 1 wherein said pair of mounting frames support an arc tube thereon.

3. The lamp assembly of claim 2 wherein said arc tube is surrounded by a shield, said shield is supported by said mounting frames and said arc tube is mounted by said shield.

* * * * *